US008142265B2

(12) United States Patent
Carter

(10) Patent No.: US 8,142,265 B2
(45) Date of Patent: Mar. 27, 2012

(54) MOTORIZED AIR VENT

(76) Inventor: Greg Carter, Oakville (CA)

( * ) Notice: Subject to any disclaimer, the term of this patent is extended or adjusted under 35 U.S.C. 154(b) by 670 days.

(21) Appl. No.: 12/100,610

(22) Filed: Apr. 10, 2008

(65) Prior Publication Data

US 2009/0258591 A1 Oct. 15, 2009

(51) Int. Cl.
*F24F 7/00* (2006.01)

(52) U.S. Cl. ..... 454/290; 454/289

(58) Field of Classification Search ..... 454/309, 454/284, 313, 287, 289, 292, 290
See application file for complete search history.

(56) References Cited

U.S. PATENT DOCUMENTS

| | | | | |
|---|---|---|---|---|
| 4,666,477 | A * | 5/1987 | Lough | 96/381 |
| 5,207,614 | A * | 5/1993 | Passadore | 454/298 |
| 5,833,134 | A * | 11/1998 | Ho et al. | 236/49.3 |
| 6,945,867 | B2 * | 9/2005 | Park | 454/324 |
| 7,628,686 | B2 * | 12/2009 | Rimmer et al. | 454/290 |
| 2007/0045440 | A1 * | 3/2007 | Wolfson | 236/49.3 |

* cited by examiner

*Primary Examiner* — Steven B McAllister
*Assistant Examiner* — Brittany E Towns
(74) *Attorney, Agent, or Firm* — Gordon Thomson

(57) ABSTRACT

A motorized air register, air diffuser or vent for HVAC systems in commercial and residential applications comprises a supporting frame abutting a floor, wall or ceiling and a second depending frame for enclosing a damper. The damper is motor driven from a first fully open position to a second fully closed position. The damper can be controlled remotely from a wall consol or in accordance with thermostat logic.

2 Claims, 7 Drawing Sheets

MOTORIZED AIR VENT

FIELD OF THE INVENTION

This invention relates to ventilation and more particularly to floor type registers and more specifically to a motorized air vent.

BACKGROUND

Air vents and air diffusers are well known in HVAC systems for commercial and residential applications. However an easily operated motorized air vent is required to prevent stooping and bending of the back when opening or closing them. Another requirement is to have a motorized air vent that can be remotely controlled from a wall mounted fixture by radio communications. Still a further requirement is to have a motorized air vent that can be logically tied to thermostats to regulate opening and closing as a function of heat demand in a particular room.

My invention seeks to satisfy these requirements by providing a motorized air vent that is easy to operate, remotely operable and capable of operation in concert with thermostats.

SUMMARY

In satisfaction of the above-cited requirements my invention provides for a motorized air vent for controlling an air flow in an HVAC system. The motorized air vent comprises a first rectangular frame adapted for supported placement abutting a planar surface; air diffusion means mounted within the first rectangular frame; a second rectangular frame depending from the first rectangular frame; vent closure means mounted operatively within the second rectangular frame and positioned adjacent to the air diffusion means; and, means for sliding the vent closure means open and closed. The first rectangular frame is sized for placement around a rectangular hole in a planar surface such as a floor, a wall or a ceiling. The first rectangular frame supports the motorized air vent within the rectangular hole. The air diffusion means comprises a first mesh pattern adapted for omni-directional air diffusion and comprises a plurality of equally spaced and parallel horizontal and vertical members forming a matrix of equally sized rectangular apertures. The vent closure means comprises a thin rectangular damper comprising a second matrix matching the first matrix. When the second matrix and the first matrix coincide the motorized air vent is full open and when the second matrix and the first matrix are fully offset, the motorized air vent is fully closed. An electric motor and cam assembly is used to move the second matrix from side to side between an open and closed position. The electric motor has control means which comprise remote control means operable from a wall consol or by operation of a thermostat.

DETAILED DESCRIPTION

Figure 1:
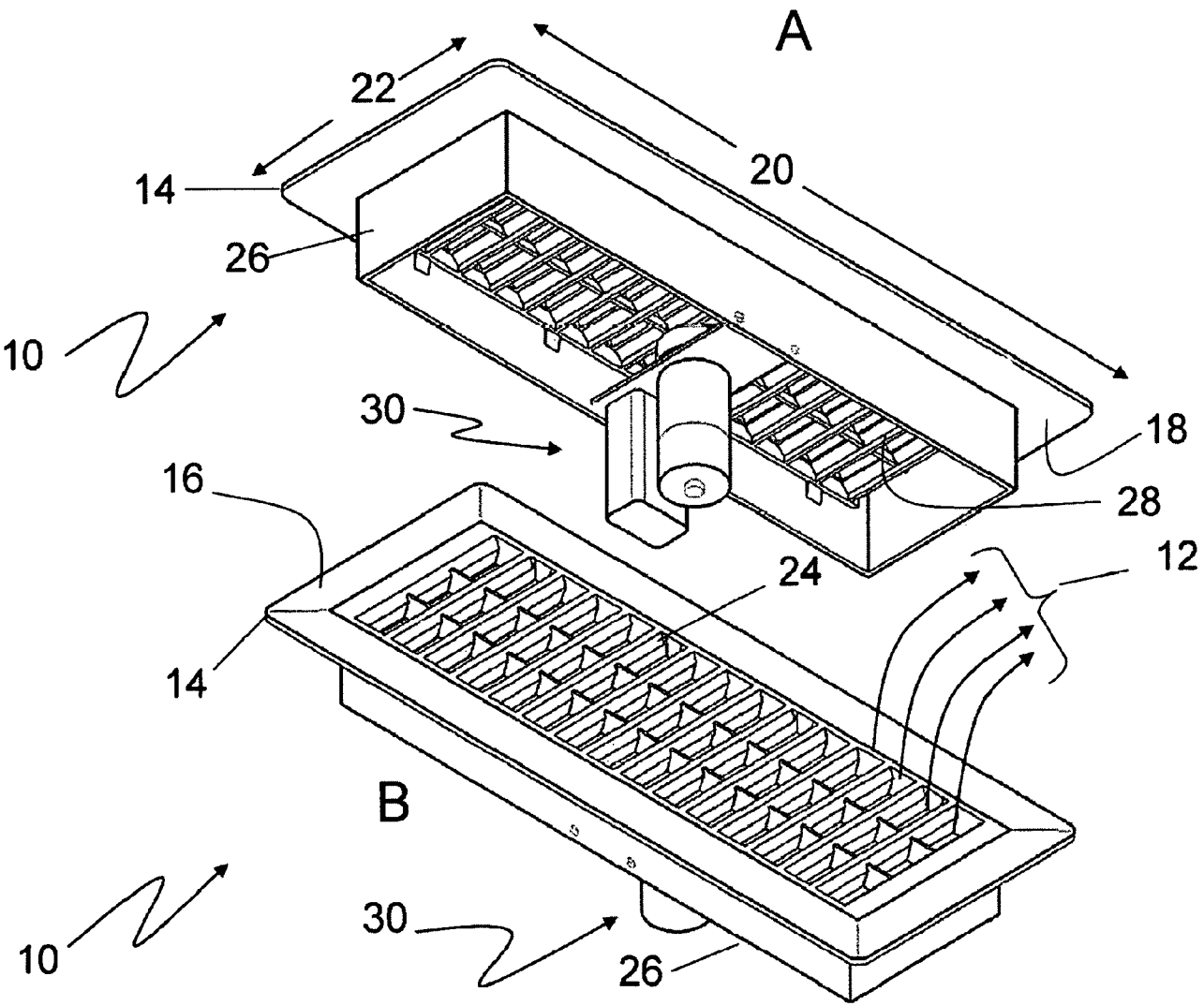
FIG. 1 is a bottom and top perspective view of one example of the invention.

Referring now to FIG. 1A and FIG. 1B, my invention is a motorized air vent (10) comprises a first rectangular frame (14) having a top surface (16), a bottom surface (18), a length (20) and a width (22). The first rectangular frame (14) is adapted for supported placement abutting a planar surface such as a floor surface, a wall surface or a ceiling surface. Within the first rectangular frame is air diffusion means (24) adapted for distributing the air flow (12) in an omni-directional pattern. In other examples of my invention, the air diffusion means can direct air in specific directions. The invention also comprises a second rectangular frame (26) depending from the first rectangular frame (14). Vent closure means (28) is mounted operatively within the second rectangular frame (26) and positioned below and adjacent to the air diffusion means (24). The invention further comprises means (30) for sliding the vent closure means (28) open and closed. Means (30) for sliding is in an operative relationship with the air diffusion means (24) permitting air flow control. In one embodiment of the invention, the motorized air vent is remotely controlled from a wall-mounted unit.

The first rectangular frame (14) is sized for placement around a rectangular hole in the planar surface. The rectangular hole terminates an air duct. The rectangular hole is sized to receive the second rectangular frame (26) in relatively air tight agreement so that the air flow through the duct is directed to the air diffusion means (24). The first rectangular frame (14) supports the motorized air vent (10) within the rectangular hole.

Figure 2:
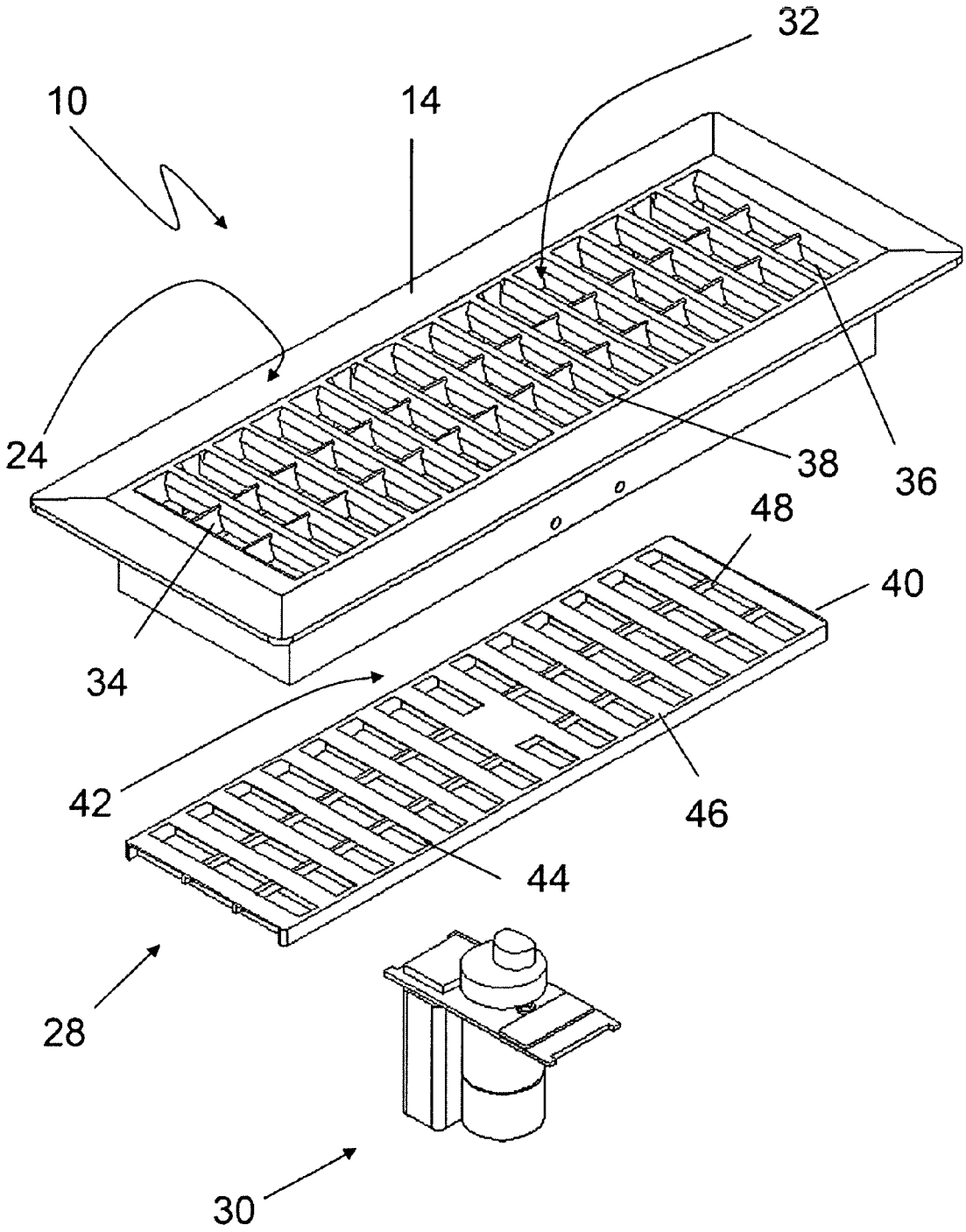
FIG. 2 is a disassembled view of one example of the invention.

Referring now to FIG. 2, the air diffusion means (24) comprises a first mesh pattern (32) adapted for omni-directional air diffusion. The first mesh pattern comprises a plurality of equally spaced and parallel horizontal (34) and vertical (36) members forming a matrix of equally sized rectangular apertures (38). The first mesh pattern is surrounded by rectangular frame (14) and generally flush with it. The vent closure means (28) comprises a thin rectangular damper (40) comprising a second mesh pattern (42) comprising vertical members (46) and horizontal members (48) thereby forming a matrix of apertures (44) matching the first matrix of apertures (38). When the apertures (44) of the second matrix and the apertures (38) of the first matrix coincide the motorized air vent (10) is fully open. When the second mesh pattern (42) and the first mesh pattern (32) are fully offset, the vertical members (46) of the damper (40) block the apertures (38) and the motorized air vent (10) is fully closed. The motorized air vent is adjustable by sliding means (30) between a fully open and a fully closed position, that is, when the first and second matrices are partially offset.

Figure 3:
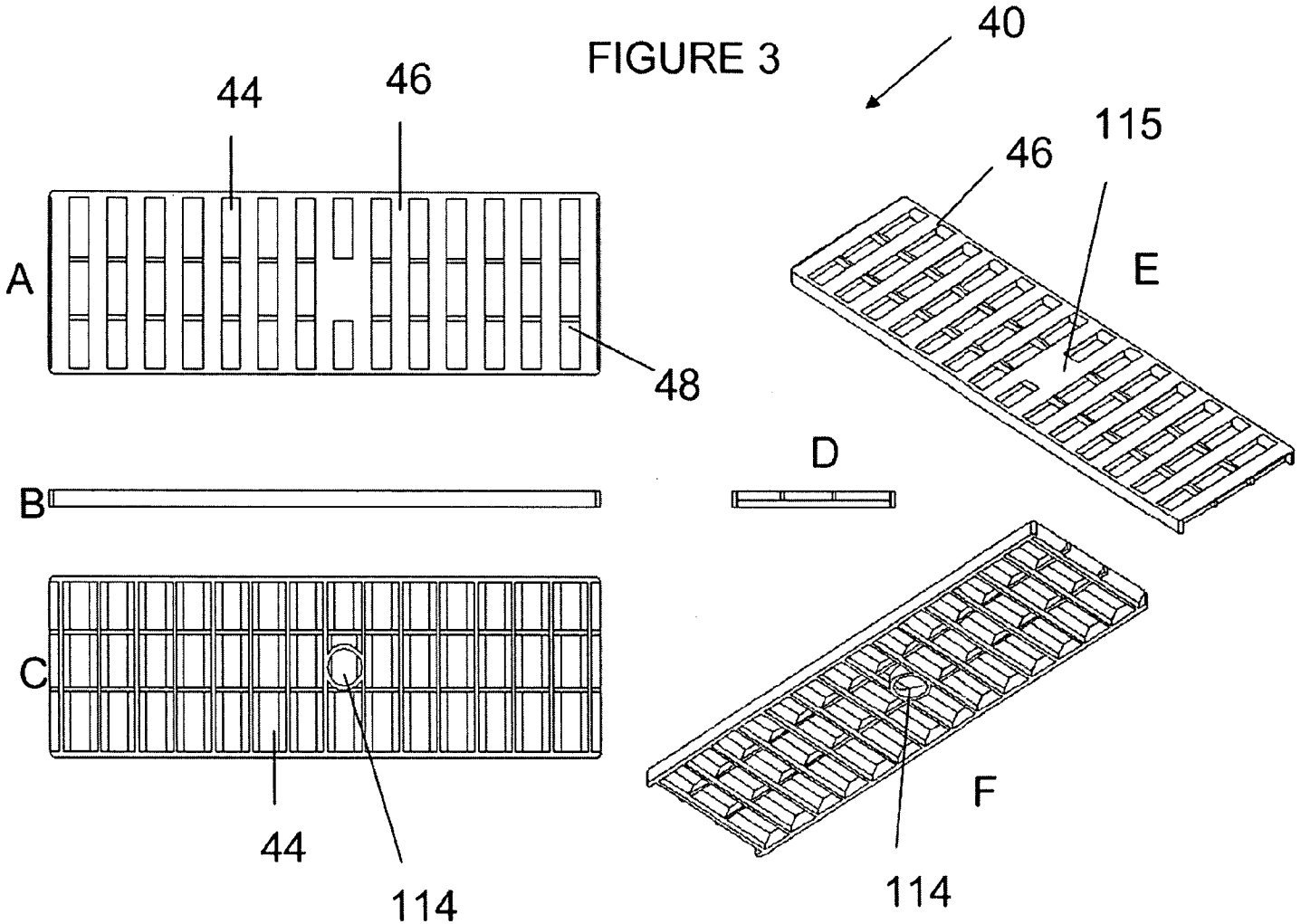
FIG. 3 comprises a number of views of the moveable damper of one example of the invention.

Referring now to FIG. 3 A to F there is shown a variety of views of the damper (40). "A" is a top view, "B" is a long-side view, "C" is a bottom view, "D" is a short-side view, "E" is a top perspective view and "F" is a bottom perspective view. Illustrated elements are the apertures (44), the vertical elements (46) of the mesh and the horizontal elements of the mesh (48). FIGS. 3C and F illustrate recess (114) located at the bottom of the damper (40). Recess (14) is open at the bottom and closed at the top (115). Recess (114) is adapted to engage the sliding means (30) as more fully explained below.

Figure 4:
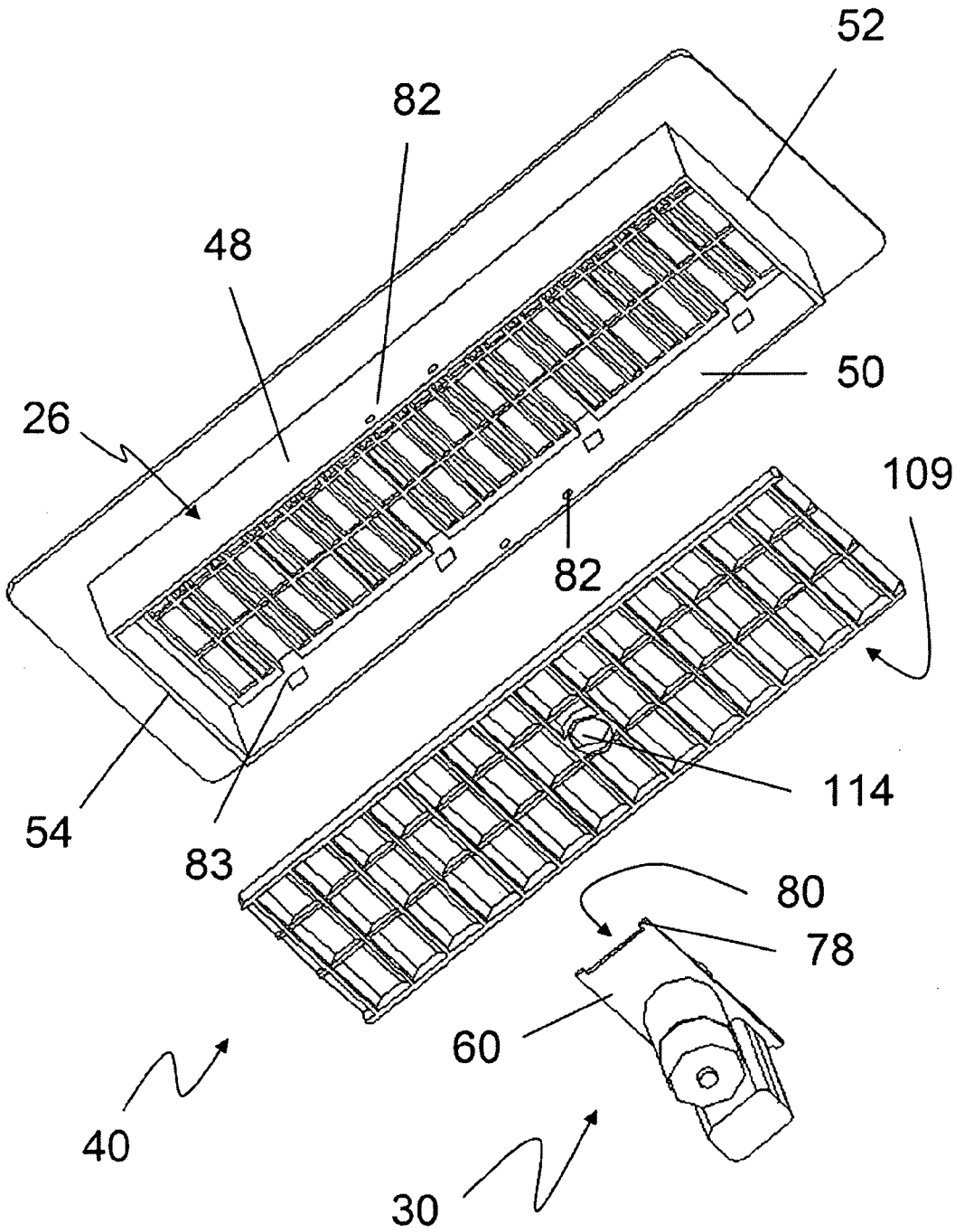
FIG. 4 is a bottom view of one example of the invention in a disassembled state.

Referring now to FIG. 4, the second rectangular frame (26) comprises a first (48) and a second (50) parallel long side rectangular members and a first (52) and a second (54) parallel short side rectangular members. These four members are joined together and define a rectangular bulkhead dimensioned to fit snuggly within the rectangular floor or wall hole while allowing easy removal of the motorized air vent from the hole. The rectangular damper (40) is permitted a sliding action within the rectangular bulkhead between a fully open position and a fully closed position along a series of bearing tabs (83) disposed on the inside surface of each parallel long side rectangular member. The rectangular damper (40) is motivated for sliding action by means (30). Also within each parallel long side rectangular members (48) and (52) are apertures (82) adapted to receive corner tabs (78) disposed on side (80) and opposite side (81) of mounting plate (60) of sliding means (30). Once assembled, the damper (40) will be disposed below the first mesh pattern (32) and slide along tabs (83). Recess (114) will engage the sliding means (30) as more fully explained blow. Sliding means will be supported from mounting board (60) which will be suspended from frame (26) by corner tabs (78) engaged with apertures (82).

Figure 5:
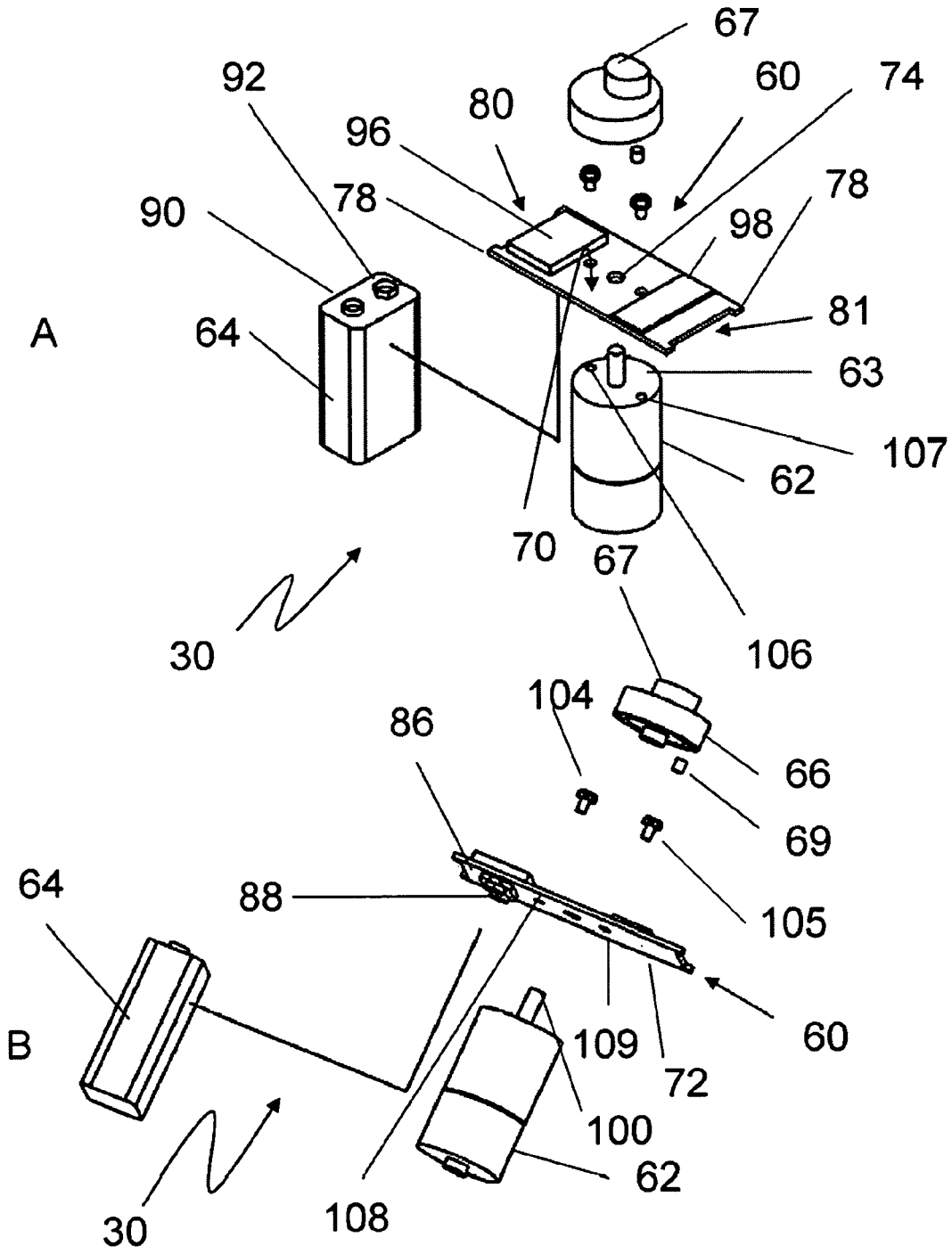
FIG. 5 comprises two views of the drive motor assembly in a disassembled state in one example of the invention.
Figure 6:
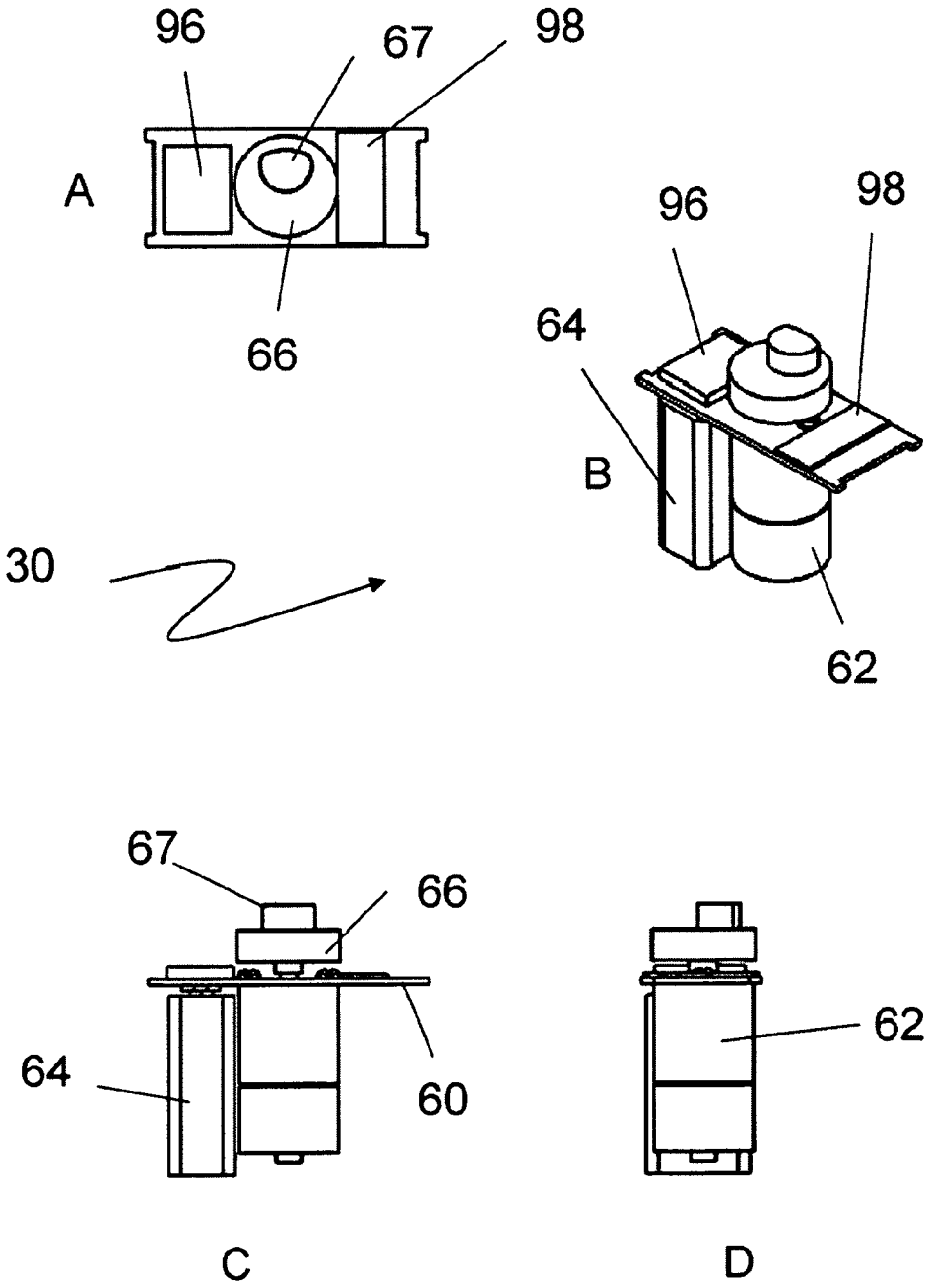
FIG. 6 comprises a variety of views of the drive motor assembly in an assembled state in one example of the invention.
Figure 7:
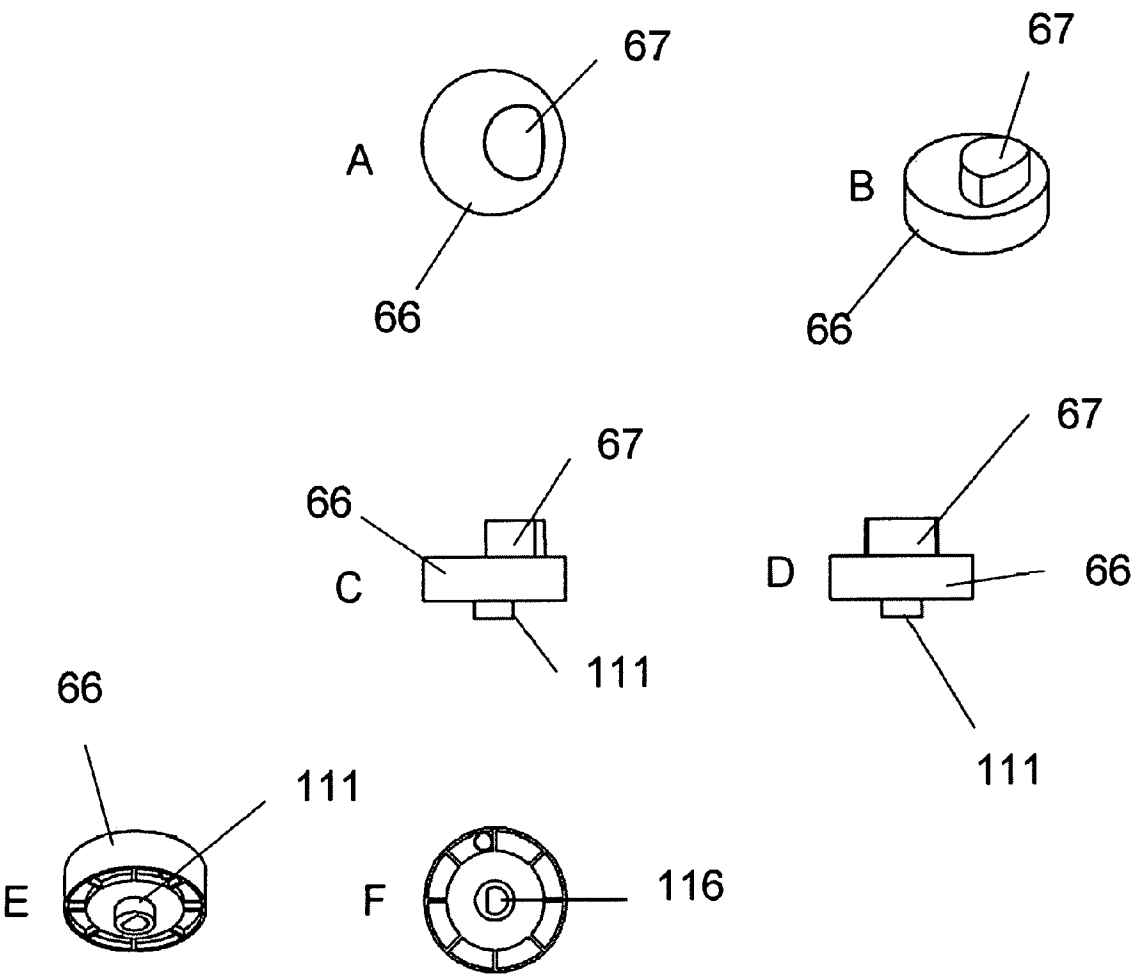
FIG. 7 comprises a variety of views of the cam body and cam head of one example of the invention.

Referring now to FIGS. 5 A and 5 B there are shown a top and a bottom perspective view of the sliding means (30) comprising a mounting plate (60) disposed beneath the rectangular damper (40) as shown in FIG. 4 and supportively attached width-wise to the second rectangular frame (26) by means of tabs (78) engaging apertures (82) in frame (26). Illustrated in FIGS. 5A and 5B are electric DC motor (62), a battery (64) in communication with the electric motor (62) and actuation means comprising a cam body (66) and a cam head (67). The cam head is in mechanical communication with rectangular damper (40) recess (114). As the cam head is turned by the motor clock-wise or counter clock-wise the damper slides from an open position to a closed position. Stop member (69) is inserted within the cam body (66) and acts to limit the movement of the cam body and cam head between a damper full open position and a damper full closed position. Mounting plate (60) comprises a top surface (70), a bottom surface (72) and a central aperture (74). As illustrated in FIG. 1 and FIG. 4, the mounting plate (60) is mounted width-wise across the second rectangular frame by mounting means comprising projections (78) protruding from each short side (80) of the mounting plate engaging apertures (82) in the long sides (48) and (50) of the rectangular frame (26).

Referring back to FIG. 5, battery (64) is mounted to the bottom surface (72) of the mounting plate (60) by battery mounting means. In FIG. 5, the battery is a 9 volt battery and mounting means are clasps (86) and (88) adapted to engage the battery terminals (90) and (92). On the top surface (70) of the mounting plate (60) there is electrical contact means (96) in electrical communication with the electric motor (62). The top surface also mounts electric motor control means (98) which may take the form of a programmable circuit to actuate the motor on a programmable basis or a radio frequency receiver to actuate the motor on a remote-control basis from either a wall mounted control or a thermostat. The electric motor (62) includes a drive shaft (100) that protrudes through aperture (74) to connect with the cam body (66). The electric motor is disposed below the mounting plate and mounted thereto by screws (104) and (105) that protrude through apertures (108) and (109) to engage threaded holes (106) and (107) in the top surface (63) of the motor casing.

Referring now to FIGS. 6A to D there are shown a variety of views of the sliding means (30) in an assembled state. Illustrated are the cam body (66) and cam head (67) mounted to the drive shaft (100) and disposed above the mounting plate (60); the battery (64) and the DC electric motor (62), the electrical connection (96) and the control means (98).

Referring now to FIGS. 7A to F there are shown top, side and bottom views of the cam body (66) and cam head (67). The cam head is adapted for engagement with a complementary recess (114) (See FIG. 4) centrally disposed in the lower surface (109) of rectangular damper (40). The attachment collar (111) depends from the cam body (66) and includes a "D" shaped orifice (116) that fits over the "D" shaped drive shaft (100). In operation, the rotation of the cam head (67) within the complementary recess (114) moves the rectangular damper (40) between fully open and fully closed. The rotation control means (Item 69 FIG. 5) restricts the rotation of the drive shaft to about 180 degrees.

Although the description above contains much specificity, these should not be construed as limiting the scope of the invention but as merely providing illustrations of some of the presently preferred embodiments of this invention. Thus the scope of the invention should be determined by the appended claims and their legal equivalents.

What is claimed is:

1. A motorized air vent for controlling an air flow, said motorized air vent comprising:

a. A first rectangular frame adapted for supporting placement in a rectangular hole within one of a floor surface, a wall surface and a ceiling surface;

b. A rectangular bulkhead depending from the first rectangular frame and dimensioned to fit snuggly within said rectangular hole while allowing easy removal of the motorized air vent from said rectangular hole;

c. A first fixed matrix of equally spaced and parallel horizontal and vertical members forming a plurality of equally sized rectangular apertures for air distribution mounted within said first rectangular frame;

d. A second sliding matrix matching said first fixed matrix and carried by a series of tabs mounted within said rectangular bulkhead beneath the first fixed matrix so that when said second matrix slides to coincide with the first matrix the motorized air vent is full open and when the second matrix slides to an offset position with respect to the first matrix the motorized air vent is fully closed and wherein the second sliding matrix has a bottom surface having a cam-complementary recess comprising a circular indentation enclosing a space having a closed top surface and an open bottom disposed in the centre thereof for accepting a rotating cam head for sliding the second matrix;

e. A mounting plate disposed beneath said cam-complementary recess and centrally attached width-wise to the bulkhead, said mounting plate having a top surface, a bottom surface and a centrally disposed aperture beneath the cam-complementary recess;

f. An electric motor mounted to said bottom surface of the mounting plate and centrally disposed within the vent, said electric motor having a shaft protruding through said centrally disposed aperture for attachment to a cam body having said rotating cam head disposed on said top surface of the mounting plate, wherein the rotating cam head is disposed within the cam-complementary recess;

g. A battery mounted to the bottom surface of the mounting plate adjacent to said electric motor and in communication with the electric motor; and, h. a remotely programmable wireless controller mounted to the top surface of the mounting plate for electric motor control.

2. The motorized air vent of claim 1 wherein said remotely programmable wireless controller communicates with one of a wall mounted consol and a thermostat is radio frequency.

* * * * *